US006239683B1

(12) United States Patent
Roessler et al.

(10) Patent No.: US 6,239,683 B1
(45) **Date of Patent: *May 29, 2001**

(54) POST-MOUNTABLE PLANAR MAGNETIC DEVICE AND METHOD OF MANUFACTURE THEREOF

(75) Inventors: Robert Joseph Roessler, Rowlett, TX (US); Lennart Daniel Pitzele, Redwood Falls, MN (US)

(73) Assignee: Tyco Electronics Logistics A.G., Steinach (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/940,672

(22) Filed: Sep. 30, 1997

Related U.S. Application Data

(63) Continuation of application No. 08/434,486, filed on May 4, 1995.

(51) Int. Cl.[7] ..... H01F 5/00; H01F 27/28

(52) U.S. Cl. ..... 336/200; 336/232; 336/83; 336/223

(58) Field of Search ..... 336/200, 232, 336/65, 83; 361/774

(56) References Cited

U.S. PATENT DOCUMENTS

| | | | |
|---|---|---|---|
| Re. 33,541 | 2/1991 | Pryst et al. | 338/226 |
| 3,965,287 | 6/1976 | Mueller | 174/66 |
| 4,672,358 | 6/1987 | Pryst et al. | 338/226 |
| 4,975,671 | 12/1990 | Dirks | 336/65 |
| 5,025,305 | 6/1991 | Tomisawa et al. | 357/72 |

(List continued on next page.)

FOREIGN PATENT DOCUMENTS

| | | | | |
|---|---|---|---|---|
| 0 608 127 A1 | | 1/1994 | (EP) | H01F/27/28 |
| 60-089907 | | 5/1985 | (JP) | H01F/27/28 |
| 61-075510 | | 4/1986 | (JP) | H01F/27/28 |
| 3-78218 | * | 4/1991 | (JP) | 336/200 |
| 3183106 | | 8/1991 | (JP) | H01F/17/00 |
| 3-283404 | * | 12/1991 | (JP) | 336/200 |
| 4142716 | | 5/1992 | (JP) | H01F/37/00 |
| 5-135968 | * | 6/1993 | (JP) | 336/200 |
| 5-59818 | * | 6/1993 | (JP) | 336/200 |
| 5-291062 | * | 11/1993 | (JP) | 336/200 |
| 6-163266 | * | 6/1994 | (JP) | 336/200 |

OTHER PUBLICATIONS

"Specifications for RM100–48 Series of Power Supplies" by Lambda Electronics Inc., dated Nov. 1994.

*Primary Examiner*—Anh Mai

(57) ABSTRACT

A post-mountable magnetic device comprising: (1) first and second conductive posts mountable to a substantially planar substrate, (2) a plurality of windings coupled to the first and second conductive posts, each of the plurality of windings having first and second conductive termination apertures at predetermined locations thereon, the first and second conductive termination apertures of the plurality of windings engaging and registering with the first and second conductive posts, respectively, the first and second conductive posts electrically coupling the plurality of windings, the first and second conductive posts therefore substantially within a footprint of the magnetic device and (3) a magnetic core mounted proximate the plurality of windings, the magnetic core adapted to impart a desired magnetic property to the plurality of windings, the plurality of windings and the magnetic core substantially free of a molding material to allow the magnetic device to assume a smaller overall device volume.

9 Claims, 4 Drawing Sheets

U.S. PATENT DOCUMENTS

| | | | |
|---|---|---|---|
| 5,050,038 | 9/1991 | Malaurie et al. | 361/386 |
| 5,055,971 | 10/1991 | Fudala et al. | 361/400 |
| 5,093,774 | 3/1992 | Cobb | 361/306 |
| 5,103,071 | 4/1992 | Henschen et al. | 219/85.22 |
| 5,161,098 | 11/1992 | Balakrishnan | 363/144 |
| 5,179,365 | 1/1993 | Raggi | 336/65 |
| 5,182,536 | 1/1993 | Boylan et al. | 336/65 |
| 5,184,103 * | 2/1993 | Gadreau et al. | 336/232 |
| 5,221,212 | 6/1993 | Davis | 439/108 |
| 5,235,311 | 8/1993 | Person et al. | 338/32 R |
| 5,249,100 * | 9/1993 | Satoh et al. | 361/774 |
| 5,267,218 | 11/1993 | Elbert . | |
| 5,337,396 | 8/1994 | Chen et al. | 385/92 |
| 5,345,670 | 9/1994 | Pitzele et al. | 29/606 |

* cited by examiner

POST-MOUNTABLE PLANAR MAGNETIC DEVICE AND METHOD OF MANUFACTURE THEREOF

This application is a file wrapper continuation of application Ser. No. 08/434,486, filed on May 4, 1995.

TECHNICAL FIELD OF THE INVENTION

The present invention is directed, in general, to magnetic devices and, more specifically to an inexpensive, readily mass-producible, post-mountable power magnetic device having a relatively high power density and small footprint.

BACKGROUND OF THE INVENTION

Power magnetic devices, such as inductors and transformers, are employed in many different types of electrical circuits, such as power supply circuits. In practice, most power magnetic devices are fabricated of one or more windings, formed by an electrical member, such as a wire of circular or rectangular cross section, or a planar conductor wound about or mounted to a bobbin composed of dielectric material, such as plastic. In some instances, the electrical member is soldered to terminations on the bobbin. Alternatively, the electrical member may be threaded through the bobbin for connection directly to a metallized area on a circuit board. A magnetic core is typically affixed about the bobbin to impart a greater reactance to the power magnetic device.

As with other types of electronic components, there is a trend in the design of power magnetic devices toward achieving increased power and volumetric density and lower device profile. To achieve higher power, the resistance of the power magnetic device must be reduced, typically by increasing the cross-sectional area of the electrical member forming the device windings. To increase the density of the power magnetic device, the bobbin is usually made relatively thin in the region constituting the core of the device to optimize the electrical member resistance. Conversely, the remainder of the bobbin is usually made relatively thick to facilitate attachment of the electrical member to the bobbin terminals or to facilitate attachment of terminals on the bobbin to a circuit board. As a result of the need to make such a bobbin thin in some regions and thick in others, the bobbin is often subject to stresses at transition points between such thick and thin regions.

Another problem associated with present-day power magnetic devices is the lack of planarity of the device terminations. Because of the need to optimize the winding thickness of the power magnetic device to provide the requisite number of turns while minimizing the winding resistance, the thickness of the electrical member forming each separate winding of the device is often varied. Variation in the winding thickness often results in a lack of planarity of the device terminations, an especially critical deficiency when the device is to be mounted onto a surface of a substrate, such as a printed circuit board ("PCB") or printed wiring board ("PWB").

A surface-mounted power magnetic device is disclosed in U.S. Pat. No. 5,345,670, issued on Sep. 13, 1994, to Pitzele, et al., entitled "Method of Making a Surface Mount Power Magnetic Device," commonly assigned with the present invention and incorporated herein by reference. The power magnetic device of Pitzele, et al. is suitable for attachment to a substrate (such as a PWB) and includes at least one sheet winding having a pair of spaced-apart terminations, each receiving an upwardly rising portion of a lead. The sheet winding terminations and upwardly-rising lead portions, together with at least a portion of the sheet windings, are surrounded by a molding material and encapsulated with a potting material. A magnetic core surrounds at least a portion of the sheet windings to impart a desired magnetic property to the device. Thus, Pitzele, et al. disclose a bobbin-free, encapsulated, surface-mountable power magnetic device that overcomes the deficiencies inherent in, and therefore represents a substantial advance over, the previously-described power magnetic devices. However, several additional opportunities to increase power and volumetric density and lower profile in such power magnetic devices remain.

First, device leads typically extend substantially from the device footprint and therefore increase the area of the substrate required to mount the device. In fact, extended leads can add 30% to the footprint or 50% to the volume of the magnetic device. Second, termination co-planarity requires either the aforementioned devices be molded in a lead frame (requiring additional tooling and tighter tolerances) or the leads be staked in after molding (requiring an additional manufacturing operation). Third, the outer molding compound employed for electrical isolation and thermal conductivity adds both volume and cost and raises device profile.

Accordingly, what is needed in the art is a power magnetic device having an improved termination or lead structure and a structure that attains an acceptable electrical isolation and thermal conductivity without requiring a molding compound. Further, what is needed in the art is a method of manufacture for such devices.

SUMMARY OF THE INVENTION

To address the above-discussed deficiencies of the prior art, the present invention provides a magnetic device comprising: (1) first and second conductive posts mountable to a substantially planar substrate, (2) a plurality of windings coupled to the first and second conductive posts, each of the plurality of windings having first and second conductive termination apertures at predetermined locations thereon, the first and second conductive termination apertures of the plurality of windings engaging and registering with the first and second conductive posts, respectively, the first and second conductive posts electrically coupling the plurality of windings, the first and second conductive posts therefore substantially within a footprint of the magnetic device and (3) a magnetic core mounted proximate the plurality of windings, the magnetic core adapted to impart a desired magnetic property to the plurality of windings, the plurality of windings and the magnetic core substantially free of a molding material to allow the magnetic device to assume a smaller overall device volume.

In a preferred embodiment, the substantially planar substrate has a window defined therein, the magnetic core at least partially recessed within the window thereby to allow the magnetic device to assume a lower profile. Some applications for the device may not allow portions of the planar substrate to be removed to form a window. In such applications, the device is fully employable, although it will have a higher profile.

In a preferred embodiment, the first and second conductive posts are soldered within the first and second conductive termination apertures. Alternatively, the first and second posts may be interference-fit with or mechanically engage with the first and second conductive posts. In another alternative, the first and second conductive posts may be made to bear resiliently against the plurality of windings to make electrical contact with the first and second termination apertures, respectively.

In a preferred embodiment, the plurality of windings are separate and mechanically joined by the first and second conductive posts. In an alternative embodiment, the plurality of windings are portions of a multi-layer flex circuit.

In a preferred embodiment, the magnetic core surrounds and passes through a central aperture in the plurality of windings. Alternatively, the magnetic core may either surround or pass through the central aperture.

In a preferred embodiment, the first and second conductive posts are mounted to the substantially planar substrate. Alternatively, the first and second posts may be through-hole mounted to the substrate.

In a preferred embodiment, the plurality of windings form primary and secondary windings of a power transformer. The plurality of windings can, however, form windings of an inductor or other magnetic device.

In a preferred embodiment, the device further comprises first and second solder preforms coupled to the first and second conductive posts, respectively, the first and second solder preforms reflowable to solder the first and second conductive posts within the first and second conductive termination apertures. Alternatively, solder flux can be applied to the first and second conductive posts.

In a preferred embodiment, the magnetic core comprises first and second core-halves. Alternatively, the magnetic core may be of unitary construction and the windings formed about a central bobbin therein.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
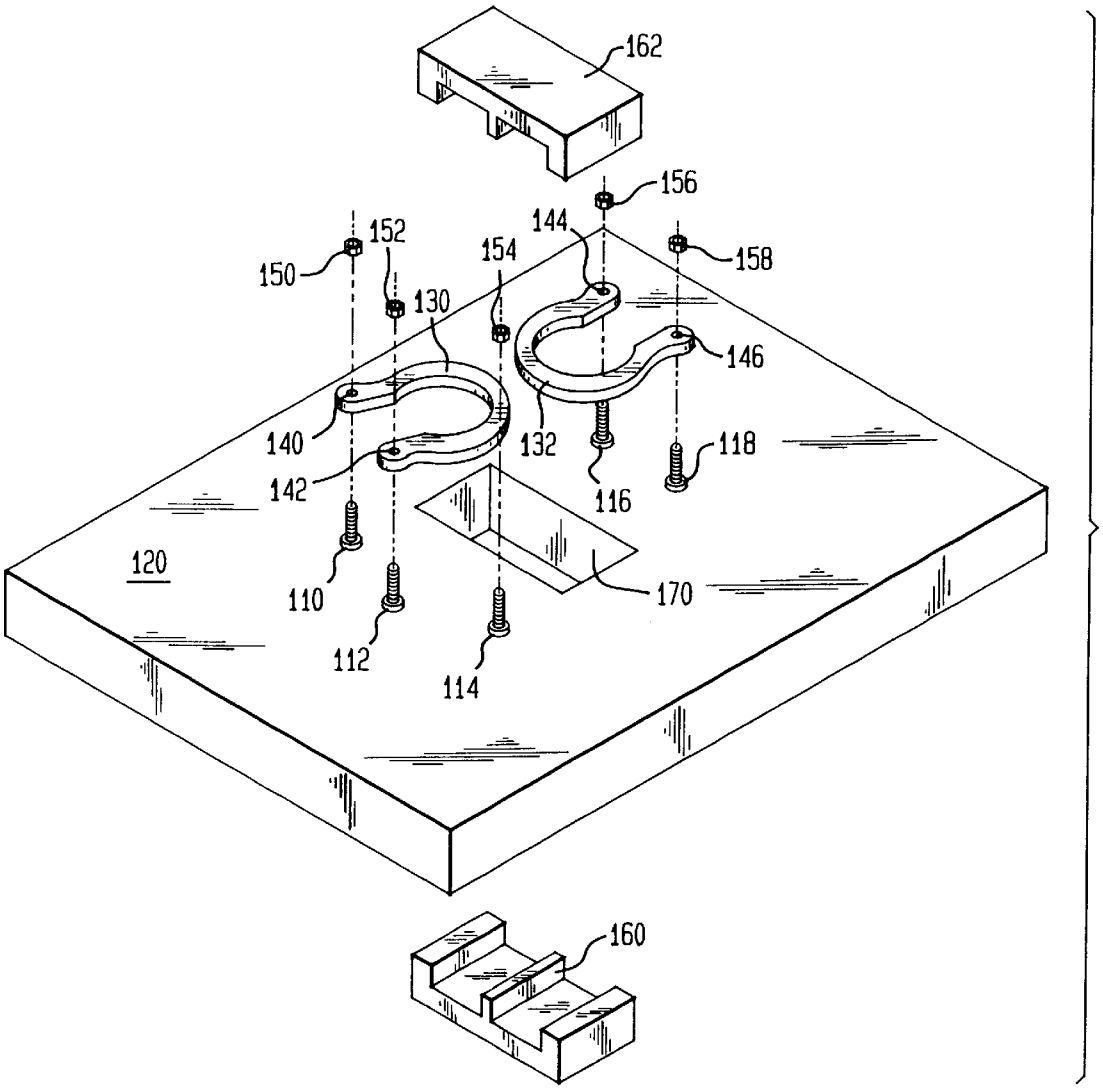
FIG. 1 illustrates an exploded isometric view of a first embodiment of the magnetic device of the present invention.

Referring initially to FIG. 1, illustrated is an exploded isometric view of one embodiment of the magnetic device of the present invention. A plurality of conductive posts are mounted to a substantially planar substrate 120, some of which posts are referenced as a first conductive post 110, a second conductive post 112, a third conductive post 114, a fourth conductive post 116 and a fifth conductive post 118. The conductive posts 110, 112, 114, 116, 118 are staked, soldered, through-holed or otherwise mounted to the planar substrate 120. While the illustrated embodiment is depicted as having five conductive posts 110, 112, 114, 116, 118, a greater or lesser number of conductive posts is within the scope of the present invention. The planar substrate 120 is typically a PCB or PWB.

A generally circular plurality of windings, namely, a first winding 130 and a second winding 132, are stacked and registered ("staked") on the conductive posts 110, 112, 116, 118, thereby mechanically coupling the plurality of windings 130, 132 and forming a conductive element. While the conductive element is shown as a plurality of individual windings 130, 132 each formed of a flat, wound-wire coil, or ring-shaped conductors, the conductive element may be, instead, a pleated flex circuit or a unitary multi-layer flex circuit, as described with respect to FIGS. 4 and 5. The plurality of windings 130, 132 can be of the same or different thicknesses, provided that the combined thickness of all the windings is less than the height of the conductive posts and the number of windings may vary depending on the application. The plurality of windings 130, 132 form the primary or secondary windings of a power transformer. Alternatively, the windings 130, 132 may form an inductor or other magnetic device.

Each of the windings or planar conductors 130, 132 has a pair of radially outward, spaced-apart conductive termination apertures at predetermined locations on the windings 130, 132. The first winding 130 is depicted as having a first conductive termination aperture 140 and a second conductive termination aperture 142; and the second winding 132 is depicted as having a third conductive termination aperture 144 and a fourth conductive termination aperture 146. The first and second conductive termination apertures 140, 142 of the first winding 130 register with the first and second conductive posts 110, 112, to form an electrical connection between the first winding 130 and the first and second conductive posts 110, 112, within the footprint of the magnetic device. Additionally, the third and fourth conductive termination apertures 144, 146 of the second winding 132 register with the fourth and fifth conductive posts 116, 118, to form an electrical connection between the second winding 132 and the fourth and fifth conductive posts 116, 118, within the footprint of the magnetic device. The conductive posts provide a strong mechanical connection to the windings thereby facilitating electrical conduction for current flow between the conductive posts and the windings.

Solder preforms secure the plurality of stacked windings to the conductive posts on the planar substrate. More specifically, a first solder preform 150 secures the windings to the first conductive post 110, a second solder preform 152 secures the windings to the second conductive post 112, a third solder preform 154 secures the windings to the third conductive post 114, a fourth solder preform 156 secures the windings to the fourth conductive post 116 and a fifth solder preform 158 secures the windings to the fifth conductive post 118. Alternative methods to secure the windings to the conductive posts 110, 112, 114, 116, 118, such as a mass reflow bonding techniques using solder paste bond or flux, interference-fitting or other means, are also within the scope of the present invention.

A magnetic core, comprising a first core half 160 and a second core half 162, surrounds and passes through a substantially central aperture of the windings 130, 132. The magnetic core is typically fabricated out of a ferromagnetic material, although other materials with magnetic properties are also within the scope of the present invention. The magnetic core imparts a desired magnetic property to the windings 130, 132. The windings 130, 132 and the first and second core halves 160, 162 are substantially free of a molding material to allow the magnetic device to assume a smaller overall device volume.

By eliminating the molding material of the prior art, the device assumes a lower profile and smaller overall volume. It has been found that elimination of the molding material causes an increase in operating temperature, albeit minimal. However, this minimal increase in temperature has no effect on the device's operation and the device safely meets the requirements of the customer in a compact cost effective design. Furthermore, since the device is intended to be joined to an underlying PCB containing other components of a power supply and then potted or encapsulated together as a unit, the differential is likely to be decreased.

In the illustrated embodiment, a window 170 is defined within the planar substrate 120. The window 170 provides a recess for the first or second core half 160, 162 thereby allowing the magnetic device to assume a lower profile. However, it should be apparent that the present invention encompasses those applications where portions of the planar substrate 120 cannot be removed to form a window. In such applications, the magnetic device has a higher profile.

Figure 2:
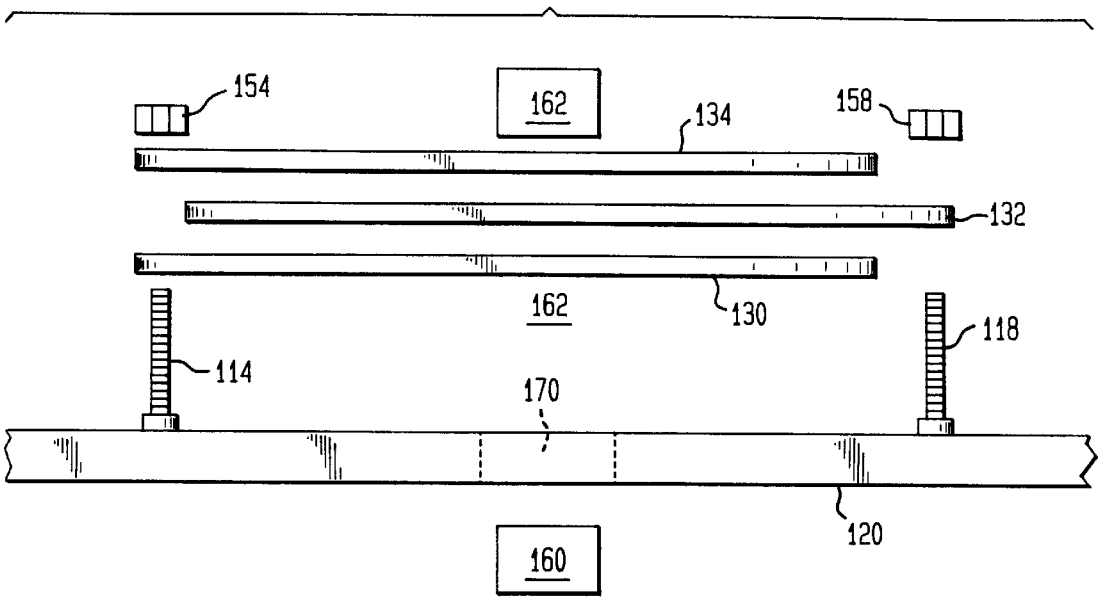
FIG. 2 illustrates an elevational view of the magnetic device of FIG. 1.

Turning now to FIG. 2, illustrated is an elevational view of the magnetic device of FIG. 1. More specifically, FIG. 2 illustrates the overlap of the first winding 130, the second winding 132 and a third winding 134 as the windings are stacked on to the conductive posts on the planar substrate 120. The third winding 134 contains a fifth conductive termination aperture 148 (not shown) and a sixth conductive termination aperture 149 (not shown) similar in design and purpose to the conductive termination apertures contained on the first and second windings 130, 132. The first winding 130 is illustrated as stacked on to the first conductive post 110 (not shown) and the second conductive post 112 (not shown). The second winding 132 is illustrated as stacked on to the fourth conductive post 116 (not shown) and the fifth conductive post 118. The third winding 134 is illustrated as stacked on to the second conductive post 112 and the third conductive post 114.

FIG. 2 further illustrates the placement of the solder preforms upon the windings stacked on the conductive posts. As illustrated in the preferred embodiment, the third solder preform 154 secures the windings to the third conductive post 114 and the fifth solder preform 158 secures the windings to the fifth conductive post 118.

Finally, FIG. 2 represents the coupling of the first and second core halves 160, 162 through the center aperture of the plurality of windings. The magnetic core is recessed into the window 170 of the planar substrate 120.

Figure 3:
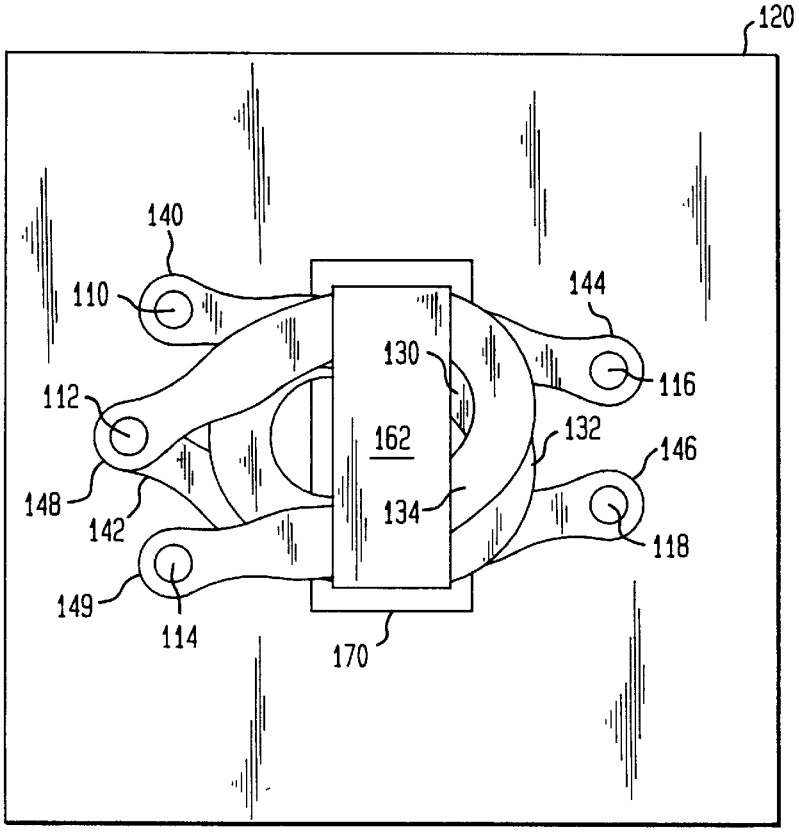
FIG. 3 illustrates a plan view of the magnetic device of FIG. 2.

Turning now to FIG. 3, illustrated is an plan view of the magnetic device of FIG. 2 assembled on the planar substrate 120. The first, second and third windings 130, 132, 134 are stacked on the conductive posts 110, 112, 114, 116, 118 through their respective conductive termination apertures 140, 142, 144, 146, 148, 149. The solder preforms 150, 152, 154, 156, 158 (not shown) secure the windings to the conductive posts 110, 112, 114, 116, 118. The first core half 160 (not shown) and the second core half 162 are displayed as assembled passing through a substantially central aperture of the windings 130, 132, 134.

Now referring jointly to FIGS. 1–3, a method for making the magnetic device encompassing the present invention will be described in greater detail. First, a planar substrate 120 (having a substantially rectangular portion removed therefrom to create a window 170 in the planar substrate 120) is provided. The conductive posts 110, 112, 114, 116, 118 are then attached at predetermined locations around the window 170 in the planar substrate 120. Next, the plurality of windings 130, 132, 134 are stacked on the conductive posts 110, 112, 114, 116, 118 through their respective conductive termination apertures 140, 142, 144, 146, 148, 149.

After the plurality of windings 130, 132, 134 are stacked on the conductive posts 110, 112, 114, 116, 118, the solder preforms 150, 152, 154, 156, 158 are deposited on the conductive posts 110, 112, 114, 116, 118. Finally, the planar substrate 120 undergoes a conventional solder reflow process and wash to secure the magnetic device mechanically to the planar substrate 150 and to establish a sound electrical connection between the magnetic device and the conductive posts 110, 112, 114, 116, 118 on the planar substrate 120.

The next operation is the magnetic core assembly. An epoxy adhesive is applied to the first core half 160 and the first and second core halves 160, 162 are rung together around a central portion of the plurality of windings 130, 132, 134. The magnetic cores are twisted to ring the adhesive and create a very minute interfacial bond line between the first and second core halves 160, 162. The first core half 160 is recessed into the window 170 located in the planar substrate 120 to reduce the overall profile of the magnetic device. The plurality of windings 130, 132, 134 and the first and second core halves 160, 162 are substantially free of a molding material to allow the magnetic device to assume even a smaller overall device volume.

This process reduces material and assembly costs by simplifying the solder processes, lead pre-forming and post forming processes and eliminating molding operations. This process also addresses and solves co-planarity and dimensional issues associated with surface mount components by eliminating the need for a bobbin or header, by foregoing an molding material and by recessing the magnetic core in the window 170 of the planar substrate 120. Finally, this process can be highly automated, with the only hand labor involved being in the conventional magnetic core assembly process.

Figure 4:
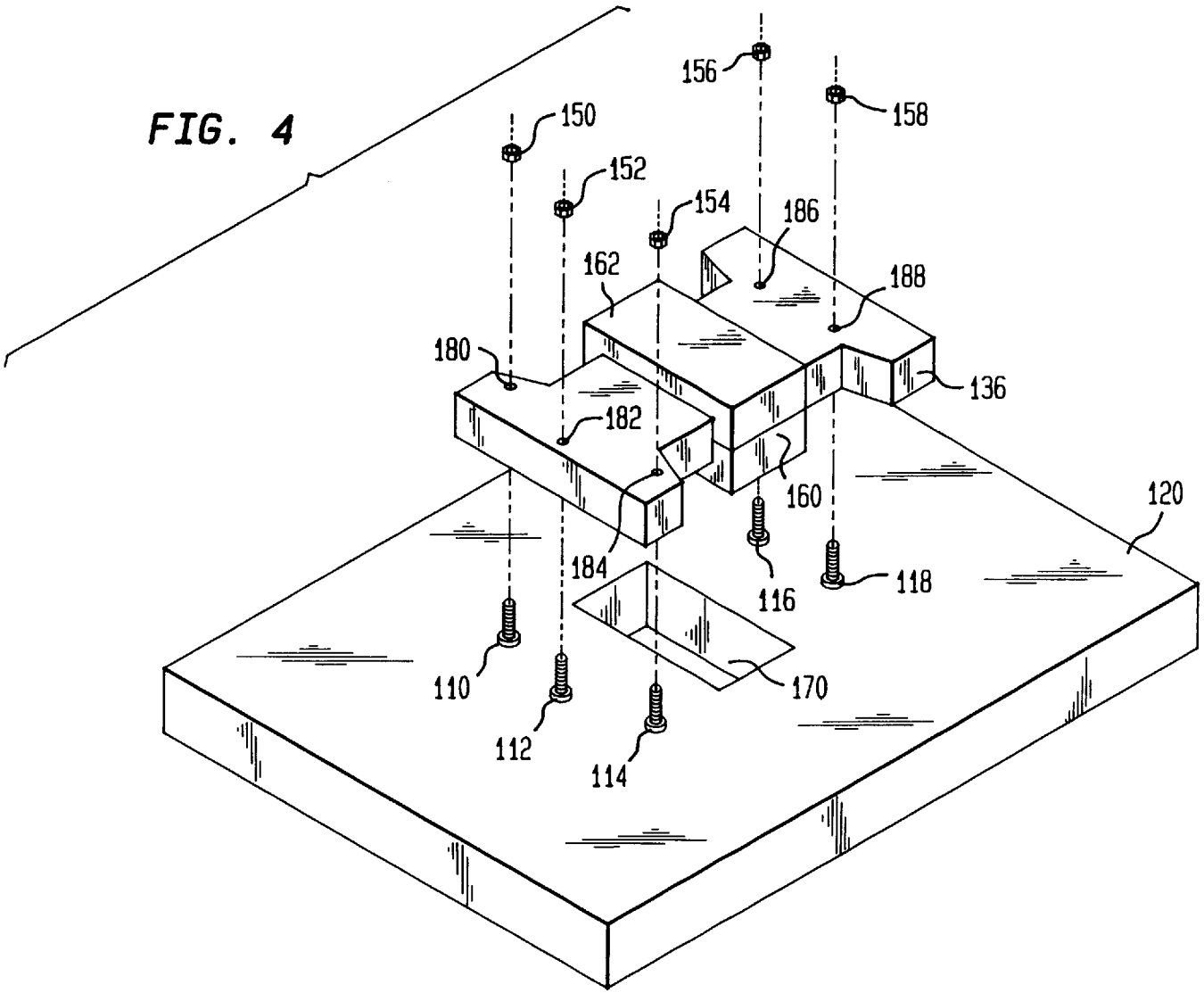
FIG. 4 illustrates an exploded isometric view of a second embodiment of the present invention.

Turning now to FIG. 4, illustrated is an exploded isometric view of another embodiment of the present invention. The preferred embodiment displays the planar substrate 120 with the window 170 recessed therein and the conductive posts 110, 112, 114, 116, 118 as described with respect to FIGS. 1–3. The embodiment further illustrates the application of a multi-layer flex circuit 136 with vias 180, 182, 184, 186, 188 cut into the multi-layer flex circuit 136 and a magnetic core. The magnetic core is displayed with the first and second core halves 160, 162 assembled around a substantially central section of the multi-layer flex circuit 136. Finally, as described with respect to FIGS. 1–3, solder preforms 150, 152, 154, 156, 158 secure the multi-layer flex circuit 136 to the conductive posts 110, 112, 114, 116, 118 on the planar substrate 120.

A method of making the magnetic device illustrated in FIG. 4 commences with the manufacturing of the multi-layer flex circuit 136. The multi-layer flex circuit 136 comprises a plurality of windings or planar conductors (not shown), arranged in layers. The multi-layer flex circuit 136 is drilled, thereby creating the vias 180, 182, 184, 186, 188. The vias 180, 182, 184, 186, 188 intersect the various conductive layers of the multi-layer flex circuit 136. Next, a conductive substance (not shown) is deposited within the vias 180, 182, 184, 186, 188 to couple the plurality of windings electrically. The vias 180, 182, 184, 186, 188 also provide a conductive path between the plurality of windings.

After the multi-layer flex circuit 136 is prepared, an epoxy adhesive is then applied to the first core half 160 and the first and second core halves 160, 162 are rung together around a central portion of the multi-layer flex circuit 136, as before.

The plated through vias 180, 182, 184, 186, 188 in the multilayer flex circuit 136 containing the planar conductors are lined up and placed on the conductive posts 110, 112, 114, 116, 118 already on the planar substrate 120. The conductive posts 110, 112, 114, 116, 118 register with the vias 180, 182, 184, 186, 188 in the multi-layer flex circuit 136 containing the planar conductors. The window 170 in the planar substrate 120 matches the outline of the magnetic core and the first core half 160 is placed in the window of the planar substrate 120. The solder preforms 150, 152, 154, 156, 158 are then deposited on the conductive posts 110, 112, 114, 116, 118 and the magnetic assembly undergoes a solder reflow operation.

Figure 5:
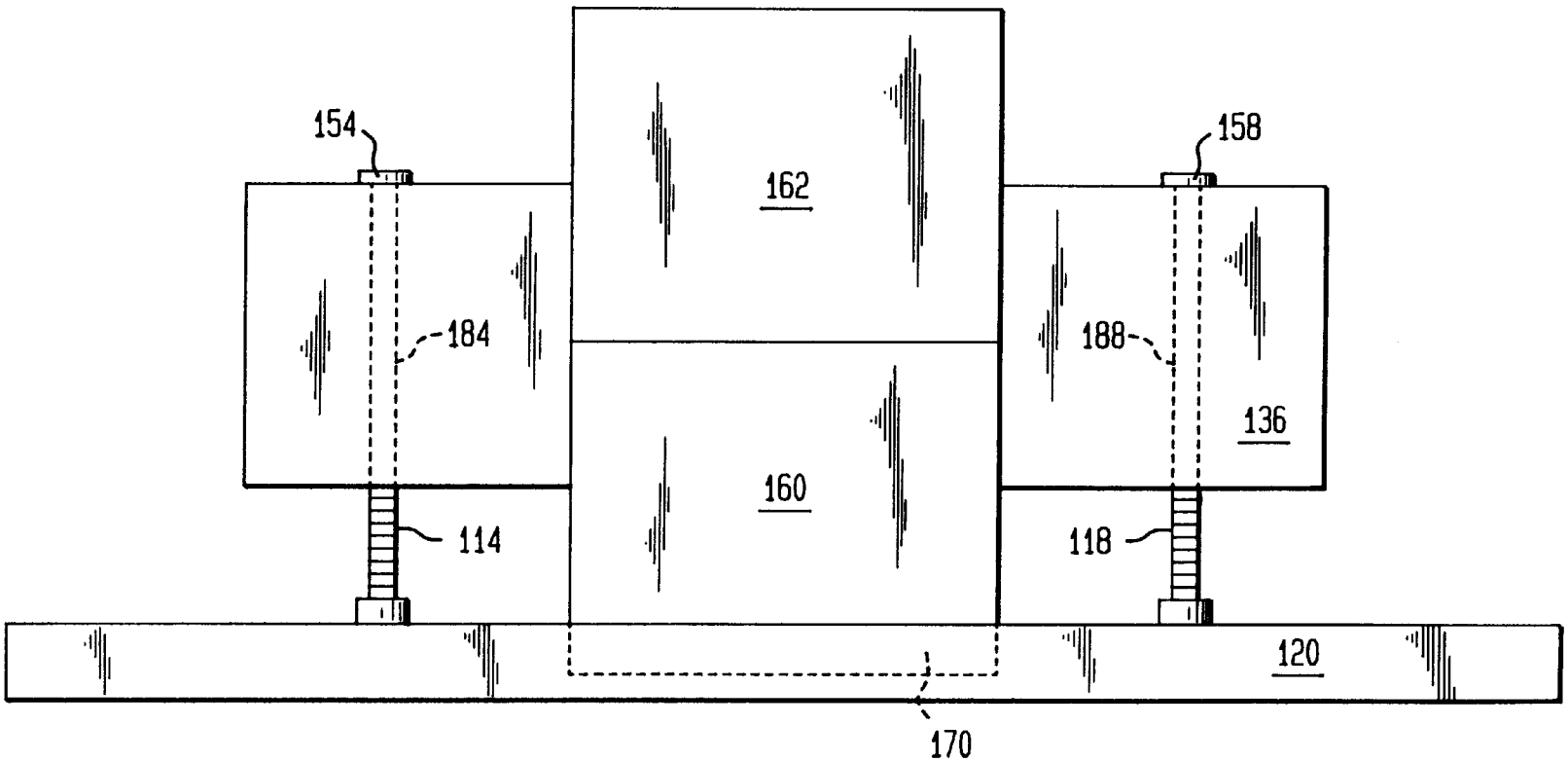
FIG. 5 illustrates an elevational view of the embodiment of FIG. 4 attached to a planar substrate.

Turning now to FIG. 5, illustrated is an elevational view of the embodiment of FIG. 4 shown attached to the planar substrate 120. As previously discussed, the magnetic device may be comprised of a multi-layer flex circuit 136, with vias 180, 182, 184, 186, 188, and a magnetic core, with a first and second core half 160, 162, surrounding a center portion of the multi-layer flex circuit 136. The magnetic core is recessed into a window 170 in the planar substrate 120 to reduce the overall profile of the magnetic device. The conductive posts and solder preforms secure the magnetic device to the planar substrate 120, and allow the vias 180, 182, 184, 186, 188 to act as conductors between the plurality of windings (not shown) in the multi-layer flex circuit 136 and electrical conductors on the planar substrate 120. A method of making the magnetic device illustrated in the embodiment of FIG. 5 is described with respect to FIG. 4.

Although the present invention has been described in detail, those skilled in the art should understand that they can make various changes, substitutions and alterations herein without departing from the spirit and scope of the invention in its broadest form.

What is claimed is:

1. A magnetic device, comprising:

a plurality of substantially uniform conductive posts having co-planar termination ends and mounted on a surface of a substantially planar substrate without passing therethrough;

a plurality of windings separate from said conductive posts and having conductive termination apertures at predetermined locations thereon, said conductive termination apertures engaging and registering with one of said conductive posts, said conductive posts substantially located within a footprint of said magnetic device; and a magnetic core mounted proximate said windings and adapted to impart a desired magnetic property thereto, said windings and said magnetic core free of a winding header to allow said magnetic device to assume a smaller overall device volume.

2. The magnetic device as recited in claim 1 wherein said substantially planar substrate has a window defined therein, said magnetic core capable of being at least partially recessed within said window thereby to allow said magnetic device to assume a lower profile.

3. The magnetic device as recited in claim 1 wherein a combined thickness of said windings is less than a height of one of said conductive posts.

4. The magnetic device as recited in claim 1 wherein said windings are separate and mechanically joined by said conductive posts.

5. The magnetic device as recited in claim 1 wherein said windings form portions of a multi-layer flex circuit and said conductive termination apertures are formed as vias in said multi-layer flex circuit.

6. The magnetic device as recited in claim 1 wherein said magnetic core surrounds and passes through a central aperture in said windings.

7. The magnetic device as recited in claim 1 wherein said windings form primary and secondary windings of a power transformer.

8. The magnetic device as recited in claim 1 further comprising a plurality of solder preforms coupled to one of said conductive posts, said solder preforms reflowable to solder one of said conductive termination apertures to said conductive posts.

9. The magnetic device as recited in claim 1 wherein said magnetic core comprises first and second core-halves.

* * * * *